US008985410B2

(12) United States Patent
Wishart

(10) Patent No.: US 8,985,410 B2
(45) Date of Patent: Mar. 24, 2015

(54) MAGNETIC GOLF BALL MARKER BRACELET

(76) Inventor: Robert Forest Wishart, Oro Valley, AZ (US)

( * ) Notice: Subject to any disclaimer, the term of this patent is extended or adjusted under 35 U.S.C. 154(b) by 0 days.

(21) Appl. No.: 13/494,671

(22) Filed: Jun. 12, 2012

(65) Prior Publication Data

US 2013/0227987 A1 Sep. 5, 2013

Related U.S. Application Data

(60) Provisional application No. 61/496,390, filed on Jun. 13, 2011.

(51) Int. Cl.
*A63B 57/00* (2006.01)
*A44C 5/00* (2006.01)

(52) U.S. Cl.
CPC ..... *A44C 5/0007* (2013.01); *Y10S 224/918* (2013.01)
USPC ..... 224/183; 224/918; 63/29.2; 473/406

(58) Field of Classification Search
USPC ..... 473/406; 224/186, 163, 219, 249, 918, 224/175, 221, 267; 63/1.12, 1.14, 29.2, 40, 63/3, 900; 24/3.7, 303
See application file for complete search history.

(56) References Cited

U.S. PATENT DOCUMENTS

| | | | | |
|---|---|---|---|---|
| 1,325,607 | A * | 12/1919 | Barber | 224/219 |
| 3,298,579 | A * | 1/1967 | Smith | 224/183 |
| 4,571,199 | A * | 2/1986 | Murakami | 446/73 |
| 6,569,039 | B1 | 5/2003 | Cope | 473/406 |
| 2006/0151562 | A1 * | 7/2006 | Moor | 224/660 |
| 2013/0020367 | A1 * | 1/2013 | Buckley | 224/584 |

* cited by examiner

*Primary Examiner* — Jack W Lavinder
(74) *Attorney, Agent, or Firm* — Hayes Soloway P.C.

(57) ABSTRACT

This invention is a bracelet designed to accommodate a metallic golf ball marker held in place by a magnet. The marker is a key part of a golf game utilized by players to mark the position of their ball on the green. By incorporating a magnet in an attractive colorful bracelet the golfer can have ready access to an easily removable and replaceable marker.

12 Claims, 2 Drawing Sheets

Magnetic Golf Marker Bracelet Single Mold

Magnetic Golf Marker Bracelet Flat Mold

MAGNETIC GOLF BALL MARKER BRACELET

CROSS REFERENCE TO RELATED APPLICATION

This application claims priority from U.S. Provisional Application Ser. No. 61/496,390, filed Jun. 13, 2011, the entire contents of which are incorporated herein by reference.

BACKGROUND OF THE INVENTION

In the game of golf it is typical for a player to mark the position of his golf ball on the green so that he may pick it up and clean it and also remove it from the path of other golfers. There are a variety of types, sizes and designs of both markers and holders for those markers. Many players simply use a coin or similar object carried in a pocket so they can retrieve it to mark the location of the ball.

Various devices such as clips that attach to belts, visors or other apparel also provide a location for holding the ball marker so that they can be easily utilized and then replaced.

SUMMARY OF THE INVENTION

My invention combines the utility of holding a ball marker while providing quick access and a bracelet that can be fashionable, monogrammed or styled in any way desired. Additionally, the molding process allows for a rapid easy method for producing this product efficiently.

The bracelet is molded with a magnet inserted in the mold and an indent to accommodate the ball marker so that the finished product allows the bracelet to be worn and a marker attached to the magnetic area of the bracelet. The surface of the molded bracelet above the magnet is molded with an indentation large enough to accommodate the shape of the designated marker to avoid the inadvertent displacement should the bracelet bump against an object. Due to the molding process, the bracelet can be any color or design.

With the popularity of bracelets in all forms being worn, the golf marker bracelet can be functional as well as stylish. The molding process allows a variety of colors and designs to be incorporated in the bracelet.

The bracelet can be cast in a single mold with a fixed diameter that slips over the hand and onto the wrist or of a stretchable compound such as silicon that can expand to slip over the hand onto the wrist and be loose or tight on the wrist as desired.

The bracelet can also be cast as a flat piece with the indent for the ball marker and embedded magnet incorporated in the mold. The ends of the bracelet can then be cut to the appropriate length and joined by gluing the ends together, or a variety of other fastening methods such as buckle or Velcro can be attached and used to form a band around the wrist. The bracelet may be cast in all sizes and shapes to be very thin or wide as the wearer desires.

REFERENCE NUMERALS

Figure 1A:
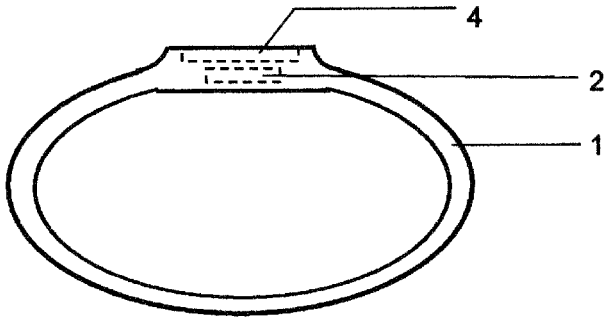
FIG. 1A is a lateral view of the single mold bracelet with dashed lines (4) showing the indent for the ball marker and dashed lines (2) showing the magnet molded into the bracelet.
Figure 1B:
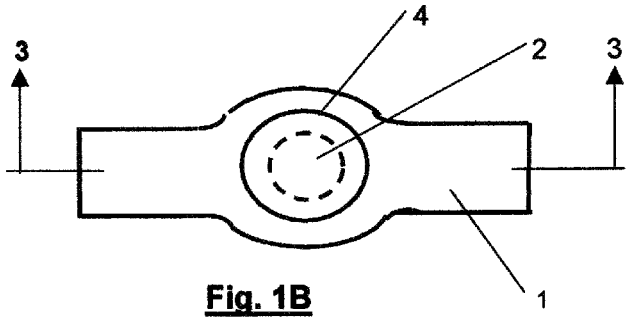
FIG. 1B is a perspective view of the single mold bracelet showing the incorporated indent (4) to hold the ball marker and dashed lines (2) representing the imbedded magnet.
Figure 1C:
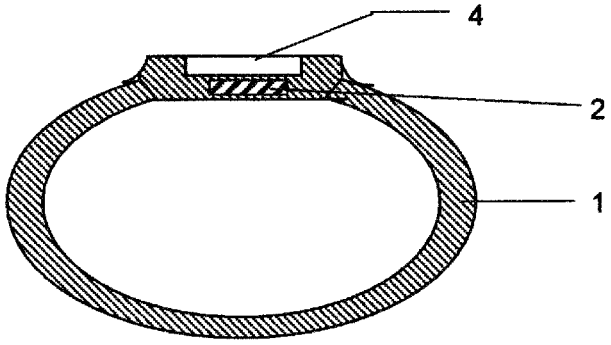
FIG. 1C is a lateral cross-sectional view of the single mold bracelet showing the ball marker indent (4) and the imbedded magnet (2).
Figure 2A:
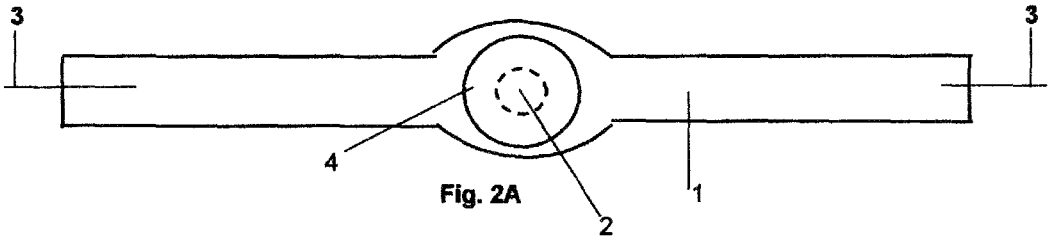
FIG. 2A is a perspective view of the flat mold bracelet showing the indent (4) for the ball marker and dashed lines (2) for the magnet molded into the bracelet.
Figure 2B:
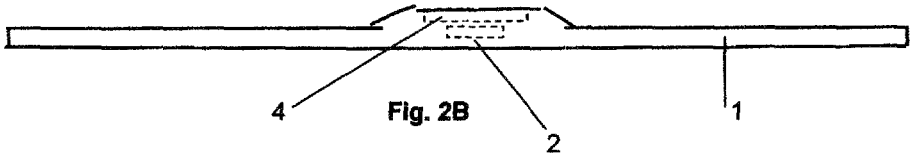
FIG. 2B is a lateral view of the flat mold bracelet with dashed lines (4) represent the indent for accommodating the ball marker, and dashed lines (2) representing the imbedded magnet.
Figure 2C:
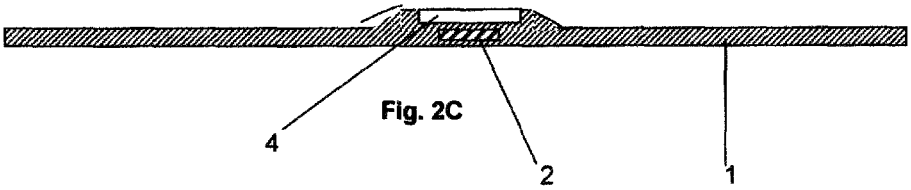
FIG. 2C is a lateral cross-sectional view of the flat molded bracelet showing the ball marker indent (4) and imbedded magnet (2).
Figure 2D:
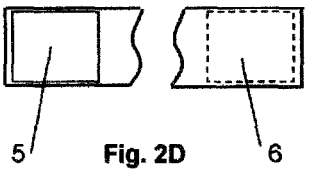
FIG. 2D is a perspective view representing the ends of the flat molded bracelet with hook (5) and loop (6) attachments such as Velcro glued to the ends to facilitate fastening.
Figure 2E:
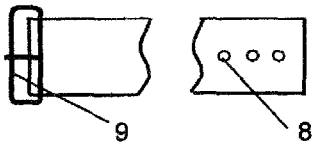
FIG. 2E is a representation of a buckle type of fastening system for the flat molded bracelet.
Figure 2F:
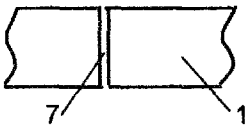
FIG. 2F is a representation of the ends of the flat molded bracelet cut to appropriate length and glued at point (7) to form a band.

1 Bracelet
2 Magnet
3 Section line
4 Ball marker indent
5 Hook portion of hook and loop fastener (Velcro)
6 Loop portion of hook and loop fastener (Velcro)
7 Glue point for flat mold bracelet

The invention claimed is:

1. A magnetic golf ball marker bracelet, comprising:

a flexible molded band having an indentation formed on an outer surface of the molded band, said indentation being sized to accommodate a golf ball marker; and a magnet disposed within the molded band and positioned between the indentation and an inner surface of the molded band; and a metallic golf ball marker sized to fit within said indentation, wherein the metallic golf ball marker, when positioned in the indentation of the molded band, is magnetically and removably held to the molded band.

2. The magnetic golf ball marker bracelet of claim 1, wherein the band comprises a single molded, circular band having a fixed diameter.

3. The magnetic golf ball marker bracelet of claim 1, wherein the band comprises a flat strip, wherein the ends of the band are configured to be attachable to one another.

4. The magnetic golf ball marker bracelet of claim 3, wherein the ends of the band are attachable to one another utilizing at least one of: an adhesive, a buckle, a hook-and-loop fasteners and a snap.

5. The magnetic golf ball marker bracelet of claim 1, wherein the band comprises a stretchable material.

6. The magnetic golf ball marker bracelet of claim 1, wherein the band comprises silicone.

7. A method of manufacturing a magnetic golf ball marker bracelet, comprising:

providing a mold shaped to form a flexible molded band having an indentation on an outer surface of the band, said indentation being sized to accommodate a golf ball marker;

positioning a magnet in the mold, said magnet positioned to be embedded within the molded band at a position between the indentation and an inner surface of the band;

forming the band using the mold; and providing a metallic golf ball marker sized to fit within said indentation, wherein the metallic golf ball marker, when positioned in the indentation of the molded band, is magnetically and removably held to the molded band.

8. The method of claim 7, wherein the band comprises a single molded, circular band having a fixed diameter.

9. The method of claim 7, wherein the band comprises a flat strip, the method further comprising:

attaching the ends of the band to one another.

10. The method of claim 7, wherein the ends of the band are attached to one another utilizing at least one of: an adhesive, a buckle, a hook-and-loop fasteners and a snap.

11. The method of claim 7, wherein the band comprises a stretchable material.

12. The method of claim 7, wherein the band comprises silicone.

* * * * *